US005904074A

United States Patent [19]

Herbert

[11] Patent Number: 5,904,074

[45] Date of Patent: May 18, 1999

[54] PACKING PULLER AND PULLER LIFTING TOOLS

[76] Inventor: Randy J. Herbert, 243 Beacon Dr., Harrisburg, Pa. 17112

[21] Appl. No.: 08/799,036

[22] Filed: Feb. 10, 1997

Related U.S. Application Data

[ 60] Provisional application No. 60/019,762, Sep. 9, 1996.

[51] Int. Cl.[6] ..... B25B 27/02

[52] U.S. Cl. ..... 81/8.1; 29/235

[58] Field of Search ..... 29/235, 267, 240.5; 81/8.1

[56] References Cited

U.S. PATENT DOCUMENTS

| | | | |
|---|---|---|---|
| 118,823 | 9/1871 | Smade . | |
| 931,718 | 8/1909 | Bales . | |
| 1,635,743 | 7/1927 | Davenport | 81/8.1 |
| 1,653,995 | 12/1927 | English . | |
| 1,758,504 | 5/1930 | English | 81/8.1 |
| 1,858,176 | 5/1932 | Webb . | |
| 2,066,598 | 1/1937 | Wiessner | 81/8.1 |
| 5,692,282 | 12/1997 | Baca | 29/235 |
| 5,695,172 | 12/1997 | Mreha | 254/18 |

FOREIGN PATENT DOCUMENTS 817730 10/1951 Germany .

*Primary Examiner*—Robert C. Watson
*Attorney, Agent, or Firm*—Richard C. Litman

[57] ABSTRACT

A packing puller and puller lifting tool are used together for extracting packing material or seals from a stuffing box, as used for sealing various hydraulic equipment such as motors, pumps, shafts, etc. The pulling tool comprises either a rigid or a flexible shaft with a bit attachment end at one end and a handle at the opposite end. The working bits may be interchangeable in order that the optimum configuration may be selected for a given job, and/or for replacement of a damaged bit. The shaft of the puller includes a series of lifting lugs permanently affixed thereto, with which a lifting or lever tool may be engaged to provide additional mechanical advantage in lifting the puller and packing from the stuffing box. The lifting tools may comprise a single elongate arm with each end having a different working bit configuration for optimum efficiency, or may comprise a lever arm with removably interchangeable bits so the appropriate bit configuration may be selected for any given situation. The lever arm and bits preferably have a mating square drive configuration, with the lever arm being similar to a square drive ratchet extension with a handle at one end thereof and the bits having square sockets opposite their working ends. Alternatively, the handle may comprise a square drive ratchet with the bits having square drive sockets in their sides, so the ratchet may be rotated in the manner used for working with a threaded fastener.

12 Claims, 9 Drawing Sheets

PACKING PULLER AND PULLER LIFTING TOOLS

REFERENCE TO RELATED PATENT APPLICATION

This application claims the benefit of U. S. Provisional patent application Ser. No. 60/019762 filed on Sep. 9, 1996.

BACKGROUND OF THE INVENTION

1. Field of the Invention

The present invention relates generally to extraction tools and the like, and more specifically to a kit for extracting packing from a stuffing box, as commonly used in hydraulic devices and steam fittings of various types. The kit comprises a pulling tool which may include either a rigid or flexible shaft, with a series of pulling lugs immovably affixed to the shaft. Various embodiments of prying or lifting tools are disclosed which engage one of the lifting lugs of the pulling tool to extract the tool, and packing with which the tool is engaged, from the stuffing box.

2. Description of the Prior Art

Hydraulic seals, generally called "packing," are commonly installed around rotating and sliding shafts in various hydraulic devices, such as valves, pumps, etc. As the name implies, the packing is generally wedged or jammed rather tightly about the shaft, and can be difficult to remove for replacement or work on the article, particularly if it is recessed within the stuffing box.

Accordingly, various tools have been developed in the past for the purpose of extracting the packing or seals from a stuffing box. These tools generally comprise a long, rigid or flexible shaft with a handle at one end and a screw type bit at the opposite end. The screw is imbedded into the packing, and the tool is pulled from the stuffing box using the handle to withdraw the packing from the box.

This process can be somewhat awkward, depending upon the force required to extract the old packing, the amount of space available to manipulate and withdraw the tool, and other factors. Yet, all of the tools known to the present inventor operate essentially on this same principle, with relatively minor variations in the configuration of the tool bit, handle, or other component. None of the prior art tools known to the inventor provide any leverage means to assist in the packing extraction process, and to provide any mechanical advantage over the straightforward procedure of pulling the tool, and packing, straight out of the stuffing box. A discussion of the packing removal tools known to the present inventor, and their differences and distinctions from the present invention, is provided below.

U.S. Pat. No. 118,823 issued on Sep. 12, 1871 to Hiram N. Smade describes an Improvement In Instruments For Extracting Packing From Stuffing Boxes. The tool includes a rigid rod with a different packing removal bit at each end. A handle is slidably installed to the rod, with the handle having a handle ring thereon. The handle may be moved to either end of the rod, so the user may select the most appropriate bit on one end or the other of the tool. However, Smade does not disclose any additional prying instruments for use with his extractor, nor does he disclose any means of applying such a prying tool to his extractor rod, as provided by the present invention.

U.S. Pat. No. 931,718 issued on Aug. 24, 1909 to Haden H. Bales describes a Packing Extracting Bit with intertwined and generally helical elements. The bit is removably secured to a shaft with a handle, with the handle comprising a flattened closed loop. No prying tool is disclosed, nor is any means disclosed of applying such a tool to the Bales extracting bit.

U.S. Pat. No. 1,653,995 issued on Dec. 27, 1927 to Frank English describes a Flexible Handled Tool having a coiled spring extension between a T-shaped handle and the interchangeable working bit. The bit may be a helical "corkscrew" type tool, or may be interchanged with a standard screwdriver bit. The present invention may also include a T-shaped handle, flexible shaft, and interchangeable bits, but English does not disclose a prying tool or means of applying such a prying tool to the extractor, each of which is provided by the present invention.

U.S. Pat. No. 1,758,504 issued on May 13, 1930 to Frank English describes a Flexible Handled Tool having a flexible shaft formed of two concentric wire coils turned oppositely to one another. A T-shaped handle and permanently affixed helical corkscrew bit are disclosed. The device is similar to that of the '995 patent to the same inventor described above, with no prying tool or means of applying such a tool being disclosed.

U.S. Pat. No. 1,858,176 issued on May 10, 1932 to Ervin F. Webb describes a Packing Extractor having a bendable housing with a flexible wire or the like therein. The wire includes a helical extractor bit formed integrally therewith, and a loop formed at the opposite end for turning the bit into the packing. The housing includes a handle affixed thereto. As in the other devices discussed above, no prying tool is disclosed, nor is any means provided for applying such a prying tool to the extractor, both of which are provided by the present invention.

U.S. Pat. No. 2,066,598 issued on Jan. 5, 1937 to Christopher E. Wiessner describes a Pulling Tool Or Implement having a shaft with a center core of flexible wire and an outer sheath formed of multiple strand cable, somewhat along the lines of the device of the '995 patent to English discussed further above. Again, no prying tool or means of applying such a prying tool to the extractor, is disclosed by Wiessner.

Finally, German Patent Publication No. 817,730 published on Oct. 18, 1951 to Karl Moosreiner et al. illustrates an extracting tool having an outer housing and concentric flexible shaft therein. The housing is apparently rigid, but is permanently bent at an angle with the flexible shaft rotating therein. Handles are provided on the ends of the flexible shaft and housing. As in the other devices discussed above, neither a prying tool nor means of applying such a prying tool to the extractor tool, is disclosed.

None of the above inventions and patents, taken singly or in combination, is seen to describe the instant invention as claimed.

SUMMARY OF THE INVENTION

The present invention comprises a packing puller and puller lifting tools, used for the removal of packing or sealing material from a stuffing box, as found in valves, pumps, and other hydraulic equipment. The packing puller includes a metal shaft, which may be a flexible cable or a rigid, solid rod. The puller has an extraction bit at one end of the shaft, comprising a helical, "corkscrew" type element, or a threaded, screw type or other element which may be interchanged therewith. The opposite end of the shaft includes a T-shaped handle, for rotating or turning the puller by hand to engage the extraction bit with the packing material and for pulling the tool and packing from the stuffing box.

The flexible or rigid shaft of the tool includes a series of lifting or pulling lugs immovably affixed therealong, to which a specially adapted lever tool may be applied to lift and pry the puller and packing with which the bit is engaged, from the stuffing box. Several embodiments of the lever tool are disclosed, comprising levers having elongate arms with various law and fulcrum configurations thereon, as well as levers having interchangeable lever or prying bits therewith, so the optimum configuration may be selected and used with a single lever arm.

Accordingly, it is a principal object of the invention to provide an improved packing puller for extracting packing and seals from stuffing boxes used in hydraulic pumps, valves, and other hydraulic-equipment, as well as lever tools for use therewith.

It is another object of the invention to provide an improved packing puller having a plurality of lifting lugs thereon and adapted to be used in combination with various embodiments of puller lever tools to lift or pry the puller, thereby providing great mechanical advantage for the user of the tool.

It is a further object of the invention to provide an improved packing puller which may have either a flexible or a rigid shaft, and which may provide for interchangeable bits of different configurations in order to optimize the tool for different situations.

An additional object of the invention is to provide improved packing puller lever tools having different jaw and fulcrum configurations for optimum efficiency in different situations.

Still another object of the invention is to provide improved lever tools having removable working ends of different configurations to optimize the lever function in different situations.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
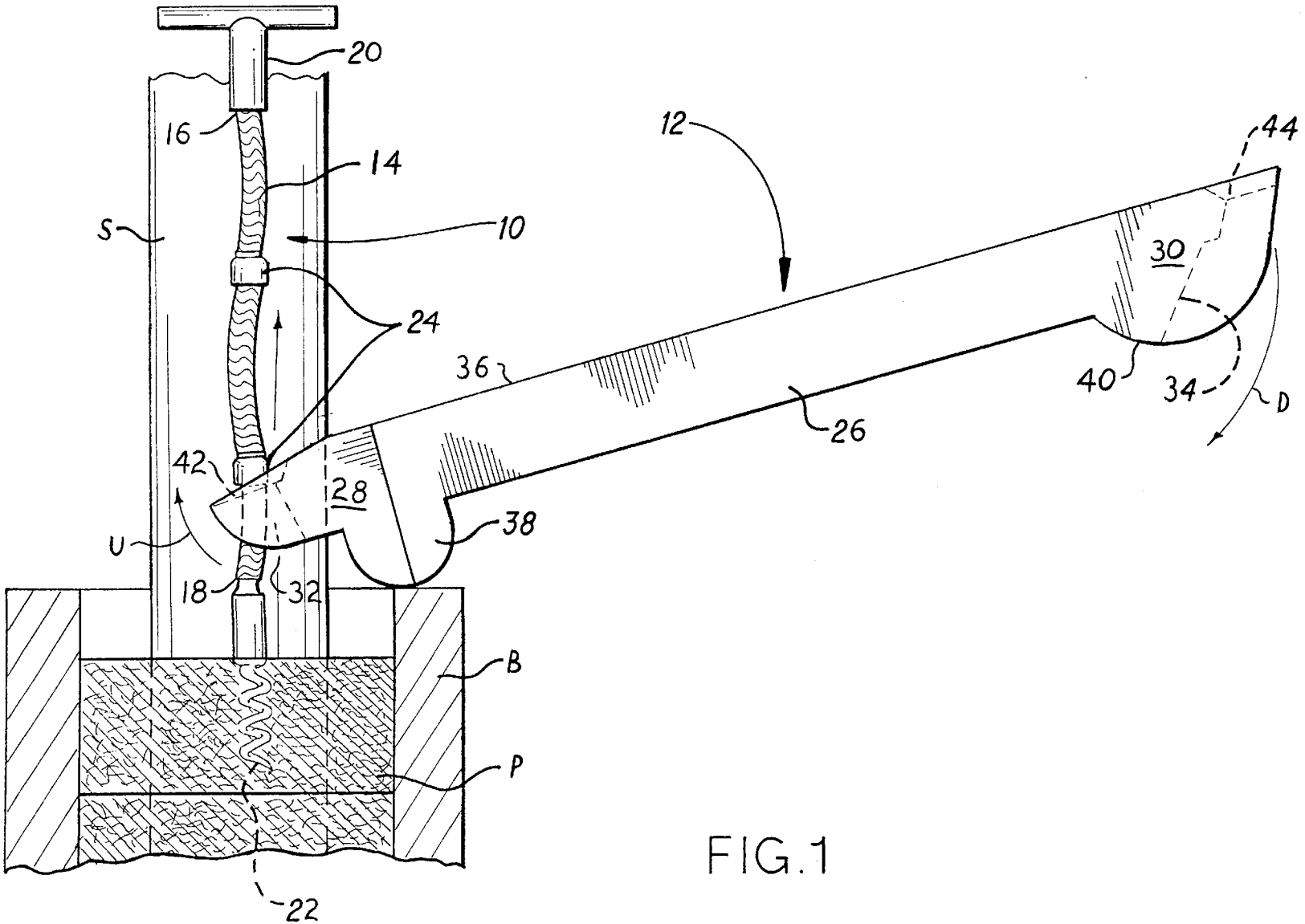
FIG. 1 is a side elevation view of a first embodiment of the present packing puller and lifting tool being used to lift and pry packing from a stuffing box with the stuffing box shown in section.

The present invention comprises various embodiments of a packing puller apparatus for the extraction of packing material P from the stuffing box B of a valve shaft S or other hydraulic apparatus. A first embodiment of the present invention comprises a kit and is shown in FIG. 1. The packing puller kit includes two basic tools or devices which are used together, the first being a packing puller tool 10 and the second being an elongate lever arm tool 12.

Figure 2:
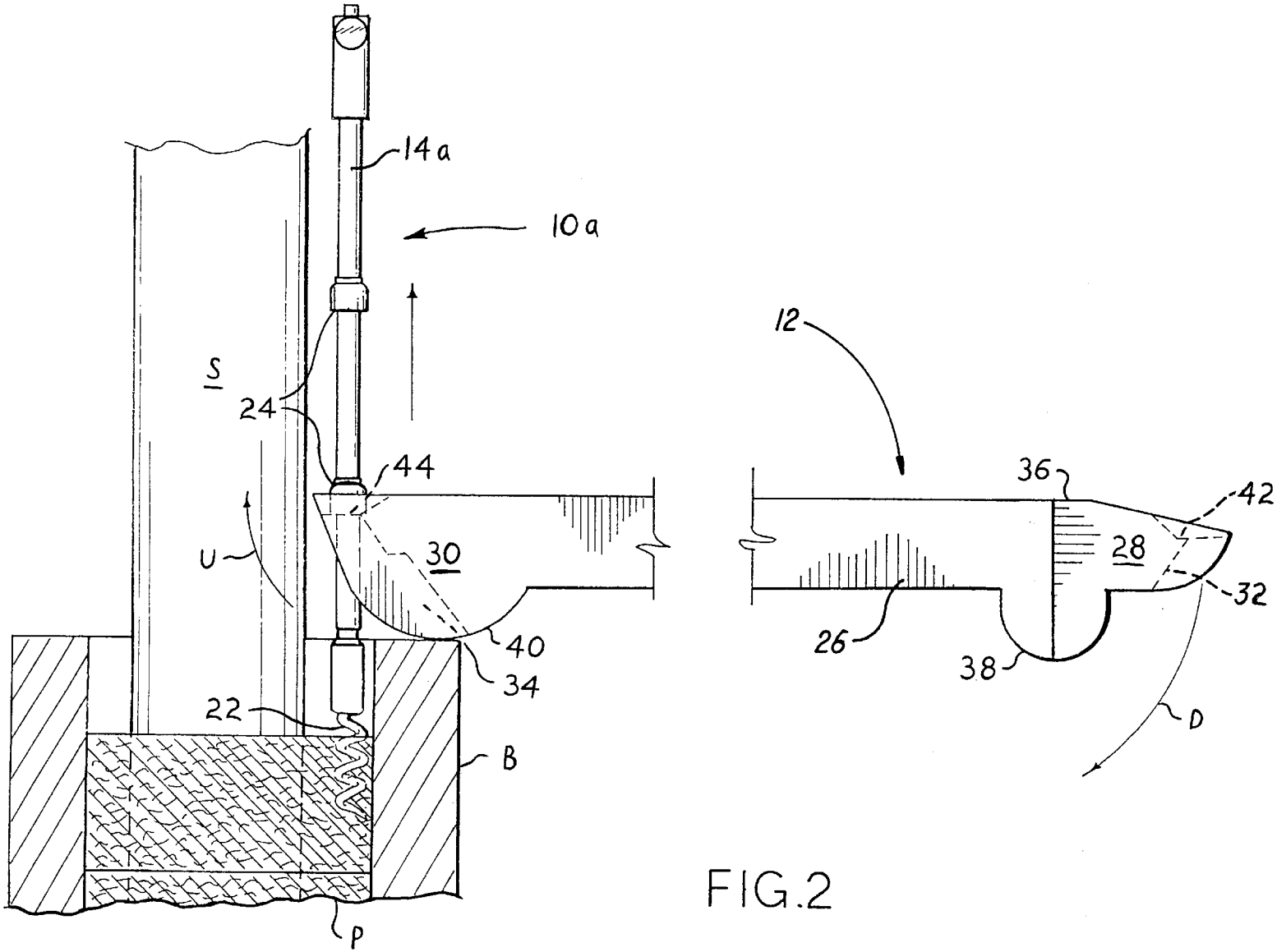
FIG. 2 is a side elevation view similar to that of FIG. 1, showing the opposite end of the lifting tool in use.

The packing puller 10 of FIG. 1 comprises an elongate flexible shaft 14 having a handle end 16 and an opposite working or bit attachment end 18, with the handle end 16 having a handle 20 extending therefrom (T-shaped handle, as shown, or other handle configuration as desired) and the opposite bit attachment end having a packing extraction bit 22 extending therefrom, shown in broken lines in FIG. 1 as it is embedded within the packing material P. The bit 22 may be a helical, "corkscrew" type bit, as shown in FIGS. 1 and 2, or other type of bit as desired. The shaft 14 of the packing puller 10 includes a plurality of lever lugs 24 affixed thereto at predetermined intervals, perhaps each one quarter inch or so along the shaft 14, or using other spacing as desired depending upon the specific application. Each of the lugs 24 comprises a ring of material of larger diameter than the shaft 14 which is swaged or otherwise immovably affixed to the shaft 14, so as to resist axial movement along the shaft 14 when a tensile force is placed upon the shaft 14 using one of the lugs 24.

The kit of FIG. 1 further includes a lever tool 12, comprising an elongate arm 26 having a first lever bit end 28 and an opposite second lever bit end 30. Each of the ends 28 and 30 includes a lever bit formed integrally therewith, for lifting or prying the packing puller tool 10 using the lever lugs 24 secured to the shaft 14 thereof. It will be seen that only one of the two ends 28 and 30 may include a lever bit therewith, but as the lever arm 26 has two ends, each may be equipped with a lever bit having a different configuration for greater versatility.

Figure 3:
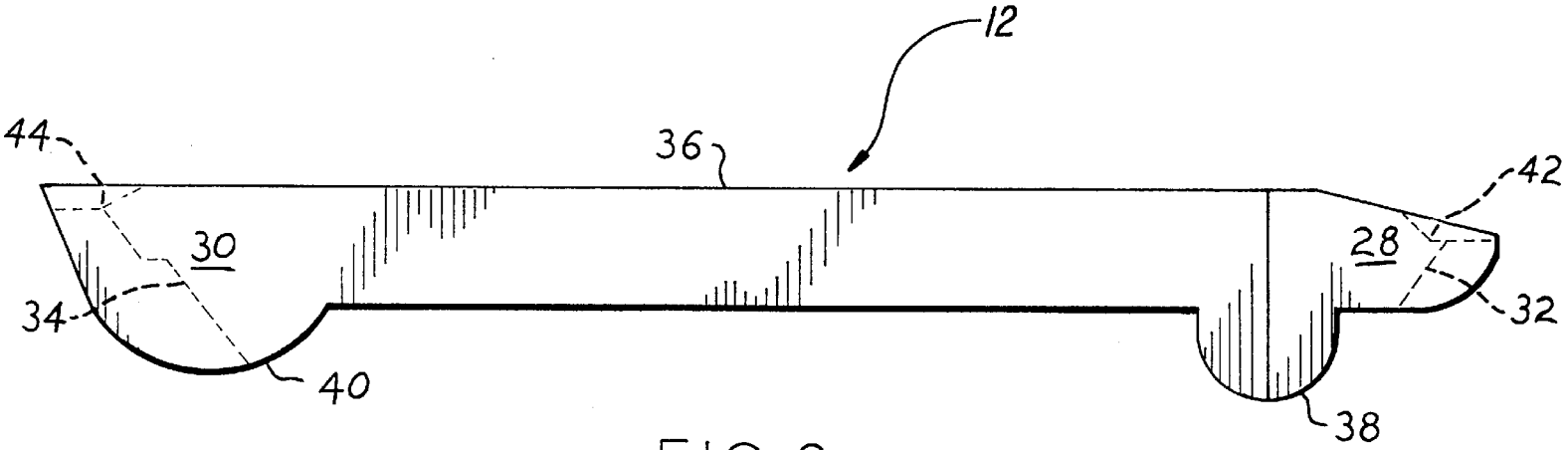
FIG. 3 is a side elevation view of the lifting tool of FIGS. 1 and 2.
Figure 4:
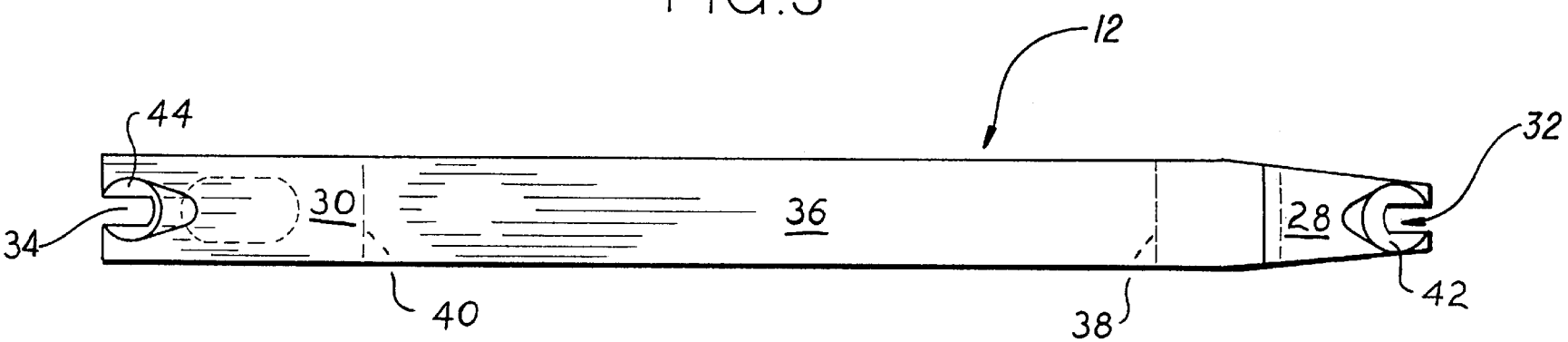
FIG. 4 is a top plan view of the lifting tool of FIG. 3.

FIGS. 3 and 4 respectively provide a side elevation view and a top plan view of the lever arm 12 of FIGS. 1 and 2, with the details of the lever bit ends 28 and 30 disclosed. Each of the lever bit ends 28 and 30 includes a channel, respectively 32 and 34, formed centrally therein from the upper surface 36 of the arm 12 downwardly to a depending fulcrum, respectively 38 and 40, below each lever bit end 28 and 30. Each of the lever bit ends 28 and 30 also includes a depression, respectively 42 and 44, formed in the upper face 36 of the arm, with the depressions 42 and 44 each being coaxial with their respective channels 32 and 34 and formed to fit substantially around the base of any one of the lever lugs 24 affixed to the shaft 14 of the packing puller tool 10. Details of the configuration of the two lever bit ends 28 and 30 may vary, e.g., the fulcrum 40 of the second end 30 being wider than the fulcrum 38 of the first end 28, the upper surface of the first end 28 being tapered, etc., in order to provide greater versatility and a more precise fit for the lever tool 12 in different situations.

The present packing puller kit is used by first threading or engaging the packing puller bit 22 of the pulling tool 10 securely into the packing material P, as shown in FIG. 1. If the packing material is not particularly difficult to remove, the pulling tool 10 may be pulled outwardly from the stuffing box B to withdraw the packing material P captured on the puller bit 22. However, oftentimes the packing material P is quite firmly packed into the stuffing box B, and additional mechanical advantage is most helpful in the removal of the packing P. Accordingly, one of the lever bit ends of the lever arm 26, e. g., the first end 28 as shown in FIG. 1, is placed with the fulcrum 38 resting upon the edge of the stuffing box B and the end 28 lowered and positioned to place the a portion of the shaft 14 of the puller tool 10 within the channel 32 with the depression 42 immediately beneath a convenient one of the levering lugs 24 affixed to the shaft 14. It should be noted that the lugs 24 shown on the shaft 14 in FIGS. 1 and 2 are relatively widely spaced for clarity in the drawings, and may be placed more closely together on an actual tool.

At this point, the user need only use the opposite end, i.e., the second lever bit end 30, as a handle to apply a downward force, as indicated by the downward directional arrow D of FIG. 1, to force the opposite first lever bit end 28 upwardly about the fulcrum 38, as indicated by the upward directional arrow U. This lifts the levering lug 24 seated in the depression 42, to lift the packing puller tool 10 and packing P from its seat within the stuffing box B. The operation may be repeated as required.

FIG. 2 discloses a side elevation view of an alternative embodiment of the puller tool 10 of FIG. 1, designated as tool 10*a* in FIG. 2. The only difference between the tools 10 and 10*a,* is that the tool 10*a* has a rigid and inflexible shaft 14*a,* rather than the flexible shaft 14 of the tool 10 of FIG. 1. However, it will be noted that the lever arm tool 12 has been turned around from its orientation in FIG. 1, with the first end 28 being used as a handle to apply a downward force and the opposite second end 30 being used to lift or lever one of the lever lugs 24 upwardly. (The orientation of the lever arm tool 12 is the same in FIGS. 2, 3, and 4, with the first end 28 being shown to the right in the drawing figures and the opposite second end 30 to the left.)

Figure 5:
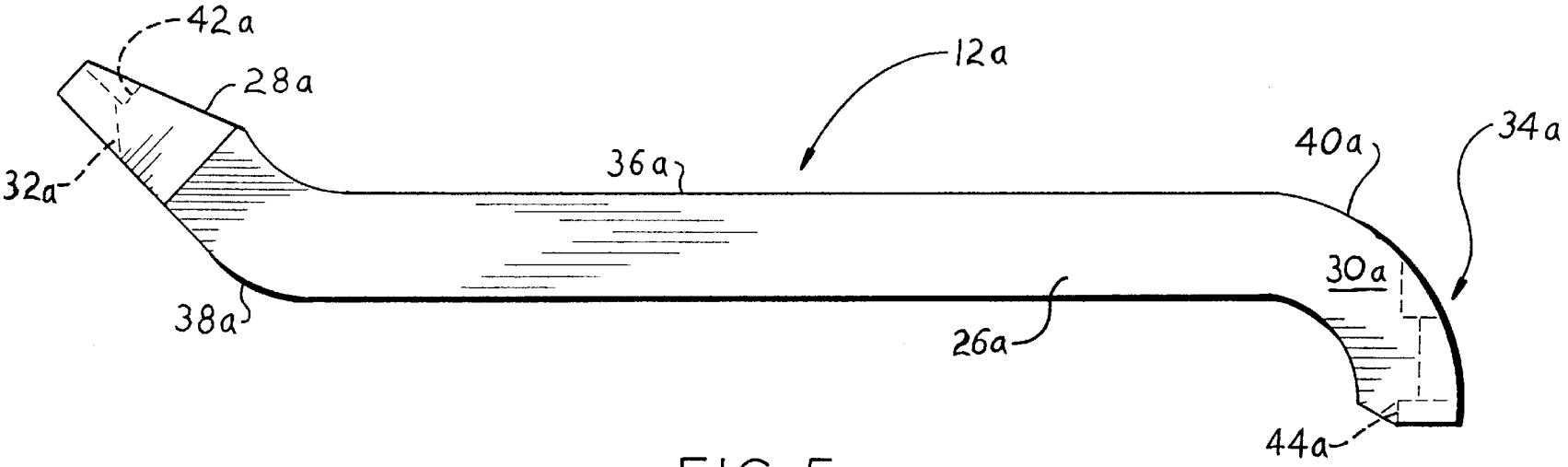
FIG. 5 is a side elevation view of an alternate embodiment lifting tool.
Figure 6:
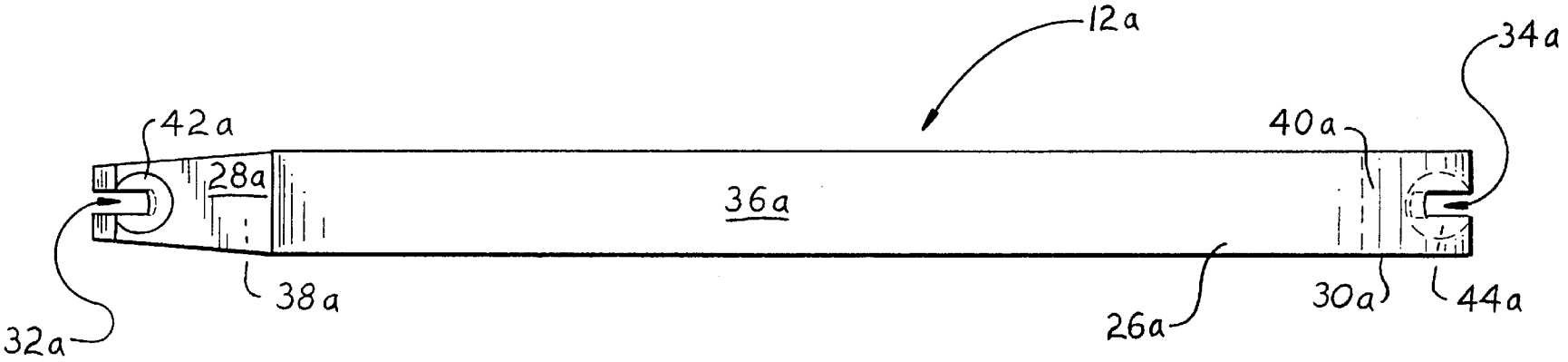
FIG. 6 is a top plan view of the lifting tool of FIG. 5.

FIGS. 5 and 6 respectively disclose a side elevation view and a top plan view of a second embodiment of the lever tool, designated as lever tool 12*a*. The tool 12*a* generally comprises an elongate arm 26*a* having a first lever bit end 28*a* and an opposite second lever bit end 30*a,* with the two lever bit ends 28*a* and 30*a* each respectively including a channel 32*a* and 34*a* therein and a lever lug depression or seat 42*a* and 44*a* coaxially disposed respectively with each of the channels 32*a* and 34*a*. However, it will be noted that the two lever bit ends 28*a* and 30*a* are axially offset from the elongate arm or bar 26*a,* rather than being generally coaxial therewith, as in the tool 12 of FIGS. 1 and 2. The outer portion of the bend radius of each of the offset portions thus serves as a fulcrum for the two lever bit ends 28*a* and 30*a,* respectively designated as fulcrums 38*a* and 40*a*.

Figure 7:
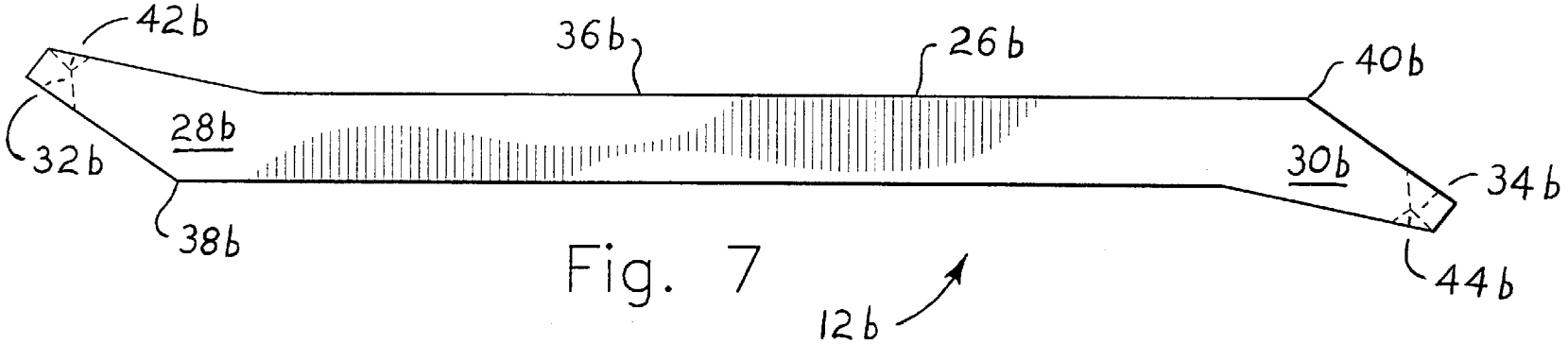
FIG. 7 is a side elevation view of another embodiment of a lifting tool.
Figure 8:
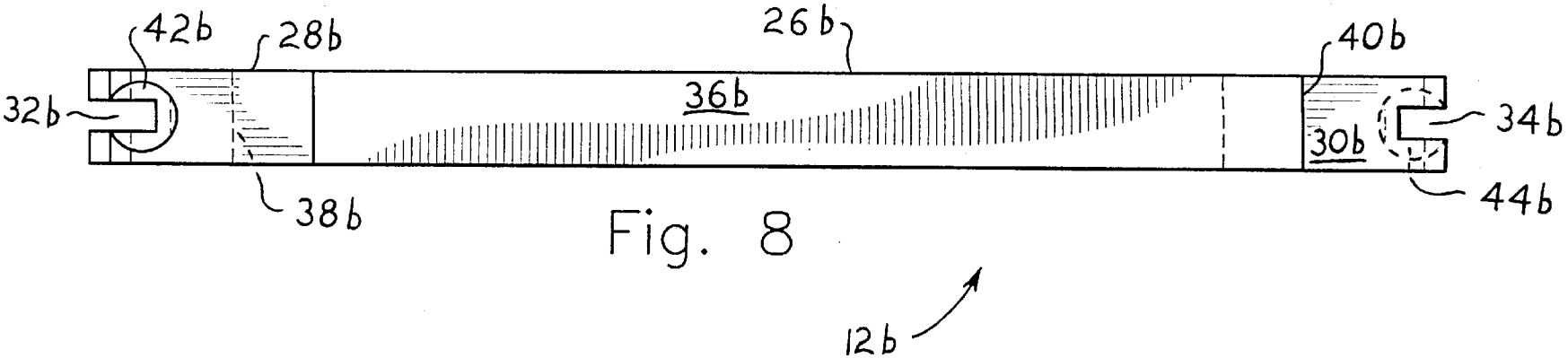
FIG. 8 is a top plan view of the lifting tool of FIG. 7.

FIGS. 7 and 8 respectively disclose a side elevation and a top plan view of a third embodiment of the lever tool, designated as lever tool 12*b*. The tool 12*b* generally comprises an elongate arm 26*b* having a first lever bit end 28*b* and an opposite second lever bit end 30*b,* with the two ends 28*b* and 30*b* each respectively including a channel 32*b* and 34*b* therein and a lever lug depression or seat 42*b* and 44*b* coaxially disposed respectively with each of the channels 32*b* and 34*b*. The two lever bit ends 28*b* and 30*b* are also axially offset from the elongate arm or bar 26*b,* in the general configuration of the tool 12*b* of FIGS. 5 and 6, but by means of an angular offset. The outer apex of the angle of each of the offset portions thus serves as a fulcrum for the two lever bit ends 28*b* and 30*b,* respectively designated as fulcrums 38*b* and 40*b*. As in the tool 12*a* of FIGS. 5 and 6, the two bit ends 28*b* and 30*b* are reversed relative to one another, facing in opposite directions relative to the upper surface 36*b* of the lever arm tool 12*b*.

Figure 9:
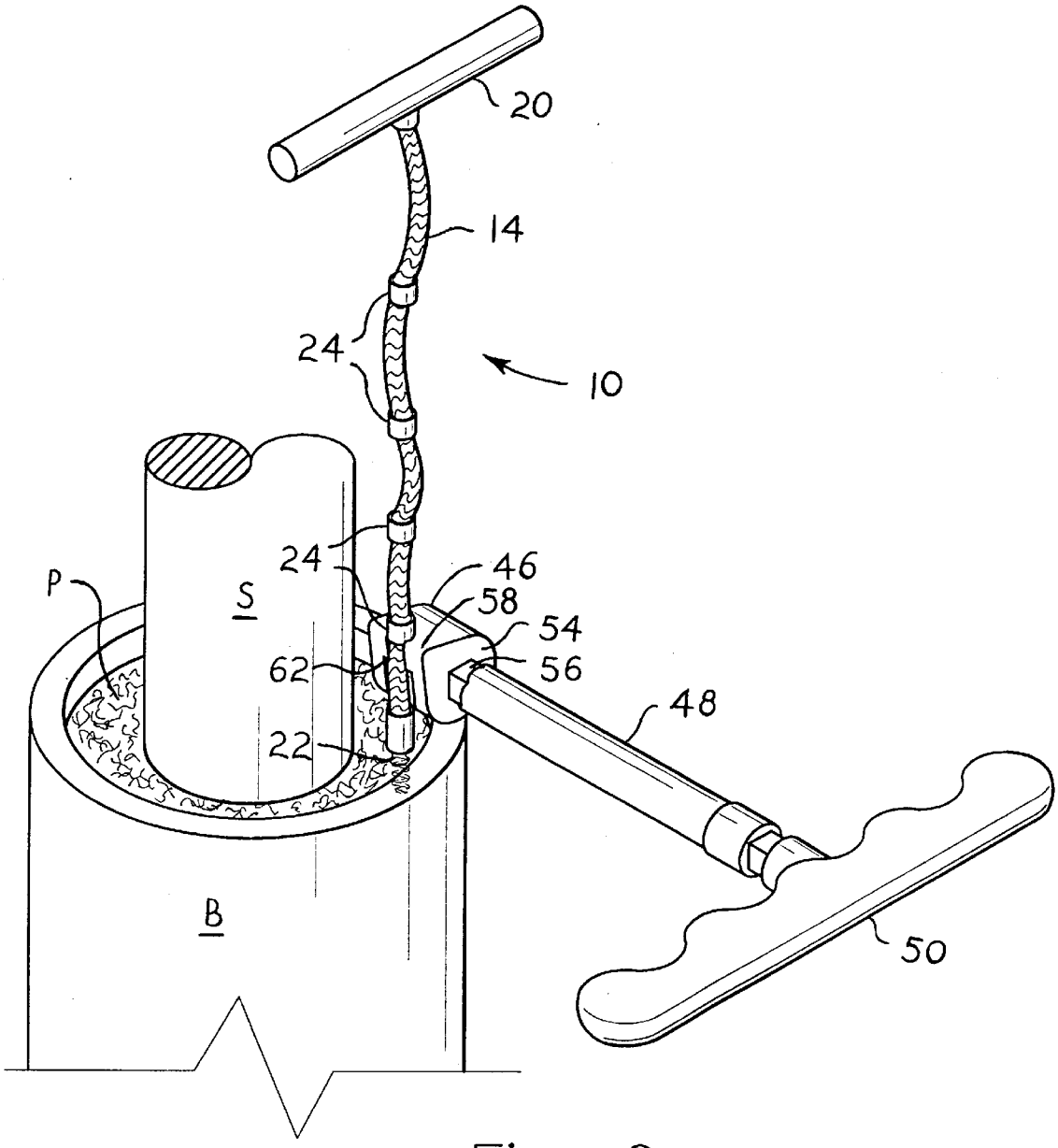
FIG. 9 is a perspective view of a flexible shaft pulling tool in use with a lifting tool having a removable and interchangeable working end.
Figure 10:
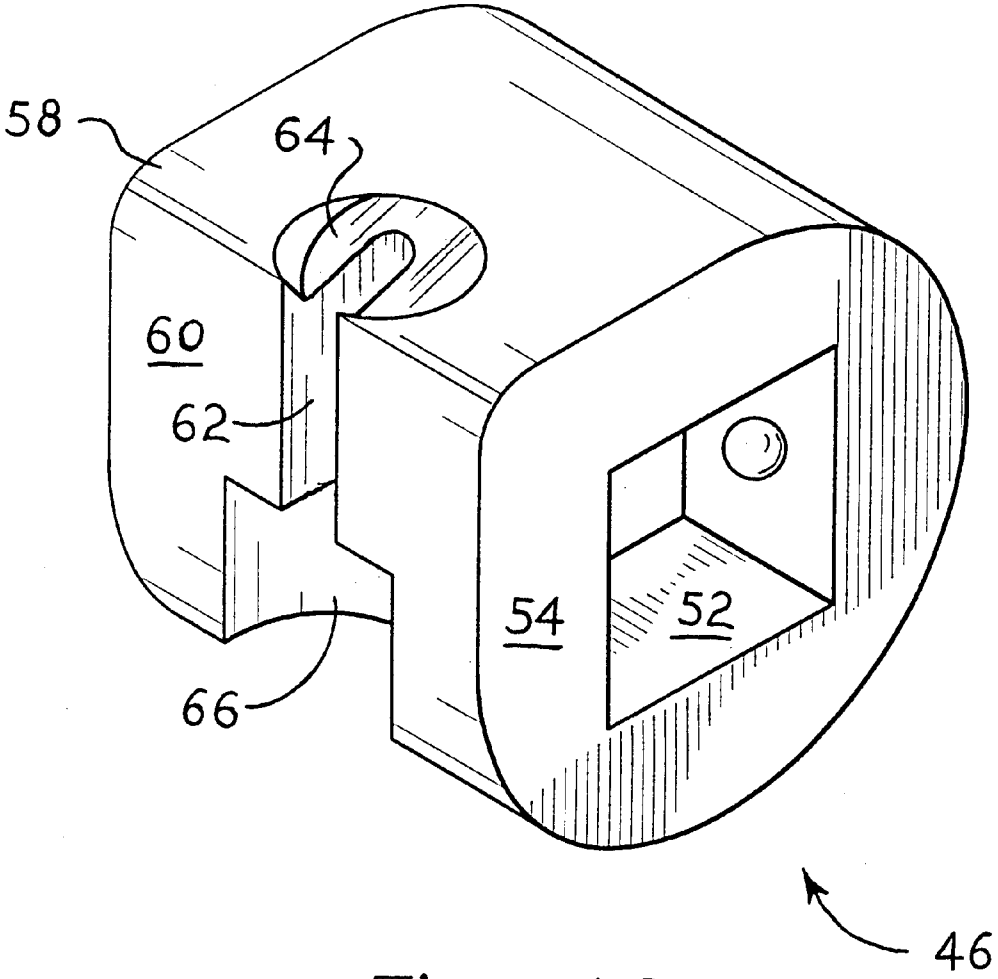
FIG. 10 is a perspective view of the working end of the tool of FIG. 9.

FIGS. 9 and 10 provide perspective views of an alternate lever tool means, wherein a generally cylindrical Lever tool 46 is used to lever or lift the pulling tool 10 and packing P from the stuffing box B. The packing puller tool 10 is essentially the same as that shown in FIG. 1 and described further above, with a shaft 14 (either flexible, or a rigid shaft such as the shaft 14*a* of the tool 10*a* of FIG. 2) with a plurality of lever lugs 24 affixed thereto, a handle 20, and a packing extraction bit 22 of appropriate configuration for imbedding into the packing P for the withdrawal thereof from the stuffing box B.

However, the lever tool 46 is considerably different than the elongate arms 12, 12*a,* and 12*b* discussed above. Rather than an arcuate motion being used to lever the tool 10 or 10*a* and packing P from the stuffing box B, the lever tool 46 relies upon a rotary motion imparted from an elongate torque arm, such as the square drive extension 48 shown in FIG. 9. Such an extension 48 may be used with a T-shaped or other handle 50 which is removably inserted into a square socket at one end of the extension 48, or with some other means of imparting rotary motion to the lever tool 46, such as a ratchet handle, etc. The lever tool 46 includes a square socket 52 in at least one end 54 thereof (such a socket may be included in both ends, if desired), into which the square drive end 56 of the torque arm extension 48 may be removably inserted.

The lever tool 46 includes a raised, cam-type projection 58 along one side 60 thereof, which serves as a fulcrum. However, this cam fulcrum 58 has a pulling tool shaft clearance channel 62 normal to the fulcrum 58, and extending across the surface or side 60 of the tool 46, as shown more clearly in FIG. 10. This channel 60 has a concentric lever lug seat or depression 64 formed therewith, in the face of the cam fulcrum 58. Thus, rather than the fulcrum being placed below the working bit portion of the lever tool, the fulcrum 58 of the lever tool 46 is positioned immediately adjacent and beneath the lever lug 24 to which the tool 46 is being applied, with rotation of the tool 46 by the torque arm extension 48 resulting in the lifting of the cam fulcrum 58, thus levering and lifting the tool 10 and packing P from the stuffing box B.

The lever tool 46 is used by installing an extension 48 thereto by means of the mating square drive 56 of the extension 48 and the square socket 52 of the lever tool 46. A handle 50 (T handle or other configuration) may be installed (either permanently or removably) to the opposite end of the extension 48, as by means of a cooperating square drive socket in the handle end of the extension 48. The packing puller tool 10 (or 10*a*) is installed into the packing P as described further above, and the lever tool 46 is inserted between the edge of the stuffing box B and a convenient one of the lever lugs 24 along the shaft 14 of the puller tool 10 or 10*a,* with the shaft 14 resting in the channel 62 of the lever tool 46 and one of the lever lugs 24 resting within the lever lug seat or depression 64 of the lever tool 46. The handle 50 is then rotated in the appropriate direction (i.e., clockwise, in the operation shown in FIG. 9) to lift the pulling tool 10 or 10*a* and packing P from the stuffing box B.

The lever tool 46 may include additional refinements to ease the operation, such as a wide relief 66 below the channel 62 to provide clearance for a lower lever lug 24 along the shaft 14 or 14*a,* and the lever lug depression 64 may be sloped to provide a better fit against the lever lug 24 as the lever tool 46 is rotated. It will be seen that the other lever arm type tools 12, 12*a,* and 12*b* discussed further above may also incorporate such reliefs and sloped or inclined depressions for the same purpose, i.e., to accommodate and fit the shaft 14/14*a* and lever lugs 24 installed thereon, to a better extent.

Figure 11:
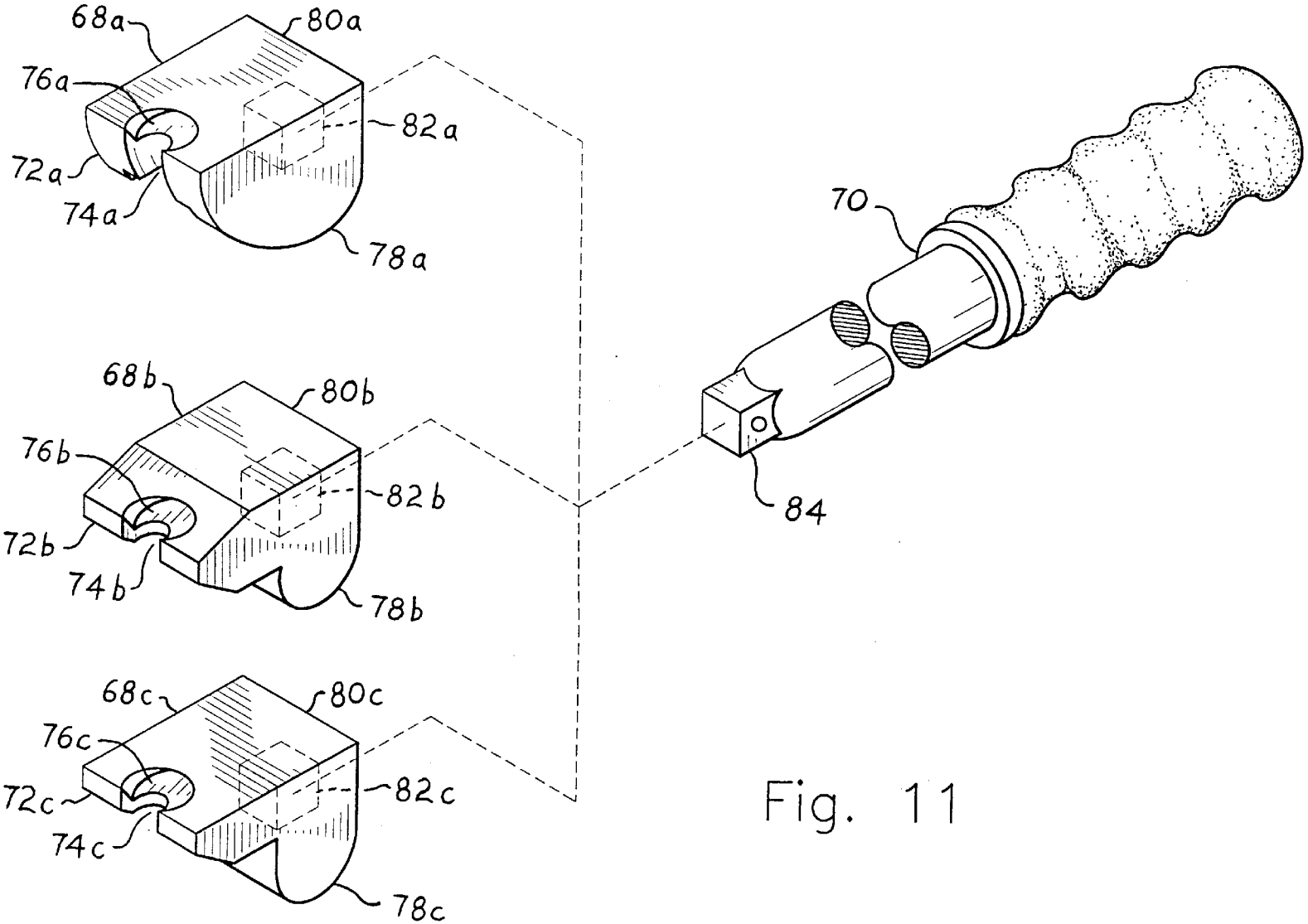
FIG. 11 is an exploded perspective view of a further lifting tool handle embodiment with interchangeable working ends therefor.

FIG. 11 discloses yet another embodiment of the lever tool which may be used with the packing puller tool 10 or 10*a* of the present invention. The lever tool of FIG. 11 is a variation upon the lever tool embodiments shown in FIGS. 1 through 8, but rather than using a single elongate arm having two lever bit ends thereon separate short lug engagement members, respectively 68*a,* 68*b,* and 68*c,* are removably and interchangeably installed to a single handle 70. Each lug engagement member 68*a* through 68*c* is configured similarly to the lever bit ends of the elongate arms of FIGS. 1 through 8, having a first end (respectively 72*a* through 72*c*) with a channel (respectively 74*a* through 74*c*), a lever lug depression (respectively 76*a* through 76*c*), and a fulcrum (respectively 78*a* through 78*c*) formed therewith. The precise configuration of each of the lug engagement members 68*a* through 68*c* may very somewhat, e.g., the fulcrums may be modified to be larger, smaller, and/or have a slightly different placement, the width of the tip or nose of any of the lug engagement members may be tapered or differently shaped to provide clearance in different situations, etc.

The second ends 80*a* through 80*c* of the lug engagement members 68*a* through 68*c* each include a square socket, respectively 82*a* through 82*c,* therein. The removable handle 70 includes a square drive 84 thereon, which mates with any one of the square sockets 82*a* through 82*c* of the lug engagement members 68*a* through 68*c.* The handle 70, with any one of the lug engagement members attached thereto, is used in the same manner as that described for the lever tools 12 through 12*b* of FIGS. 1 through 8.

To this point, the packing puller tool 10 (having a flexible shaft 14) and 10*a* (with a rigid shaft 14*a*) have been described as having a packing extraction bit 22 permanently affixed to the working end of the shaft 14 or 14*a.* However, it will be seen that providing for the removable replacement of the bit 22 would provide greater versatility for the tool 10 or 10*a,* in the event the bit was damaged, or a different type of bit was determined to be more efficient, etc. Accordingly, FIG. 12 discloses a packing puller tool shaft, designated as shaft 14*b,* to which different packing puller bits may be removably secured.

Figure 12:
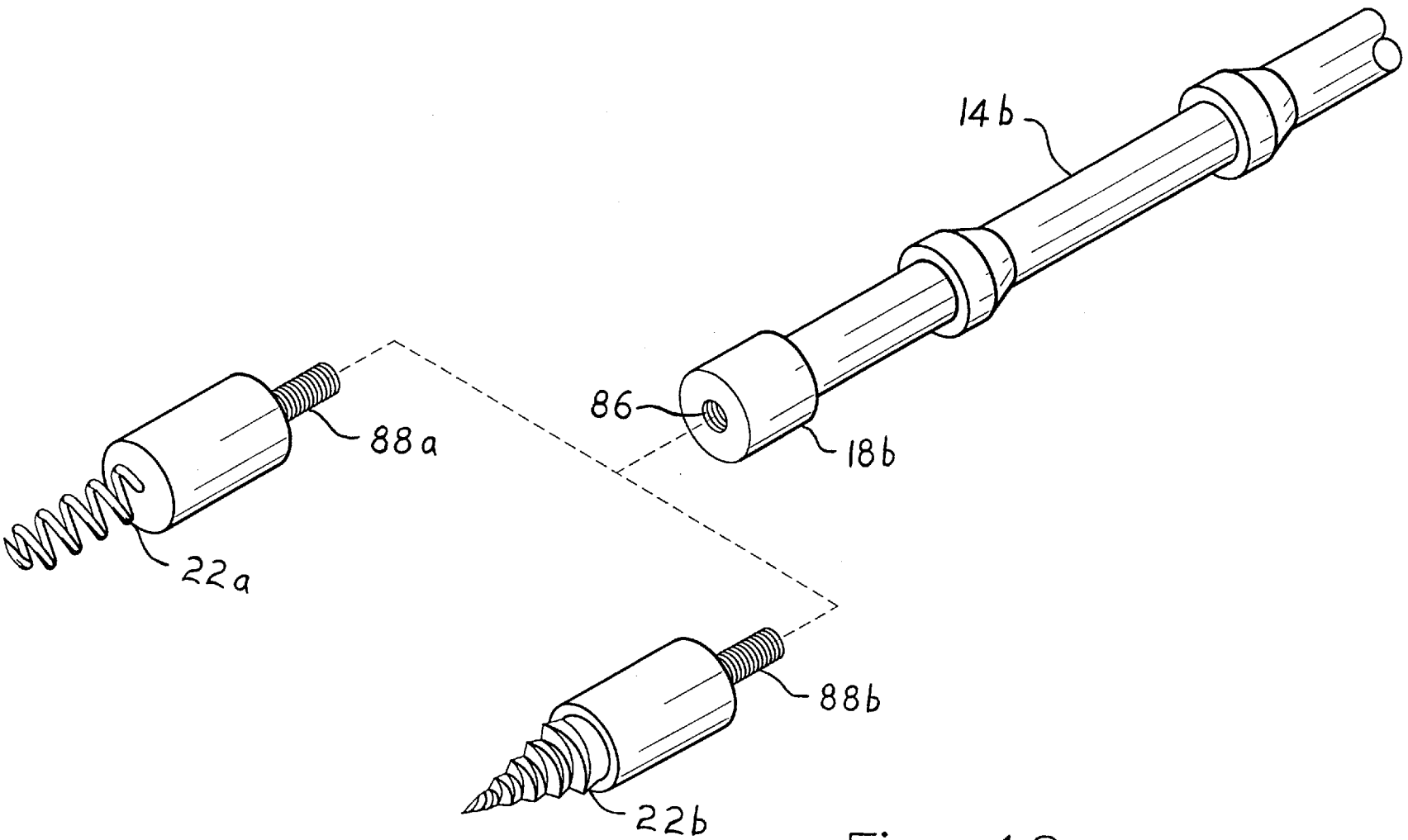
FIG. 12 is an exploded perspective view of the working end of a solid shaft pulling tool with interchangeable bits.

The bit attachment end 18*b* of the shaft 14*b* includes an internally threaded hole 86 therein, which mates with the externally threaded fasteners 88*a* and 88*b* of the two packing puller bits 22*a* and 22*b* shown in FIG. 12. The threads are turned in the same direction as the direction of the spiral of the helical corkscrew bit 22*a* and threads of the tapered threaded bit 22*b,* so that as the shaft 14*b* is turned into the packing material (e.g., clockwise for right hand spirals and threads) the attachment of the removable bits 22*a* and 22*b* to the bit attachment end 18*b* of the shaft 14*b* will tend to tighten, rather than loosen. Once the packing material has been extracted from the stuffing box, the shaft 14*b* (and bit 22*a* or 22*b* attached thereto) may be unscrewed from the packing material. If the bit 22*a* or 22*b* remains in the packing material, it is easily removed by unscrewing, and/or destroying the used and no longer serviceable packing material to remove the bit 22*a* or 22*b* therefrom.

In summary, the packing puller and puller lifting tools, either in kit form or separately, will be seen to provide a most convenient accessory for persons who have need to perform repairs on various hydraulic components such as valves, pumps, motors, etc. The kit is used by first disassembling the valve, pump, or other hydraulic device to the extent necessary to gain access to the stuffing box. An appropriate size and configuration of the present pulling tool and lever tool are selected (the present tools may be manufactured in any of a variety of sizes and configurations), depending upon the size of the stuffing box and valve. Any gland nut and gland follower present would be removed for clearance to the packing material (the gland nut and follower may be tied out of the way with a Nylon cable tie or other suitable means).

The pulling tool is then inserted into the stuffing box and turned to engage the packing extraction bit with the packing material. The lever tool is then installed with the channel placed about the shaft of the pulling tool and with the lever lug seat or depression immediately below an appropriate one of the lever lugs on the shaft. The handle (or tool body) is arcuately and downwardly moved (or the torque arm extension is turned, for the lever tool 46 of FIGS. 9 and 10), forcing the packing puller tool outwardly from the stuffing box. The process may be repeated as required, with the lever tool being removed and reengaged with the next lever lug along the shaft as required until all packing material has been removed from the stuffing box.

The mechanical advantage provided by the present invention, with its lever tools and lever arms and/or torsion arms, can be of great assistance in the removal of packing material from stuffing boxes, particularly in environments where the packing is deeply seated, tightly packed, and/or difficult to access due to the location of the stuffing box. The hydraulic mechanic or other person who has occasion to remove packing material from stuffing boxes in such situations, will find that the present tools will pay for themselves in terms of time and effort saved, in a very short time.

It is to be understood that the present invention is not limited to the sole embodiments described above, but encompasses any and all embodiments within the scope of the following claims.

I claim:

1. A kit for extracting packing from a stuffing box, comprising:

a packing puller tool including a shaft having a handle end with a handle affixed thereto and an opposite bit attachment end with a packing extraction bit affixed thereto for engaging the packing, said shaft including a plurality of lever lugs affixed thereto at predetermined intervals; and at least one lever tool, wherein said lever tool is an elongate arm including a first end with a first lever bit formed integrally therewith and an opposite second end with a second lever bit formed integrally therewith, with each said end including a fulcrum depending therefrom and with each said lever bit including a channel centrally formed therein for placing of said shaft of said packing puller tool therein and further including an upper face having a depression therein coaxial with said channel, with said depression adapted to fit one of said lever lugs for lifting and prying said packing puller tool and the packing from the stuffing box.

2. The kit according to claim 1, wherein said shaft of said packing puller tool is rigid and inflexible.

3. The kit according to claim 1, wherein said shaft of said packing puller tool is flexible.

4. The kit according to claim 1, wherein said packing extraction bit is removably affixed to said bit attachment end of said shaft of said packing puller tool.

5. The kit according to claim 1, wherein said packing extraction bit of said packing puller tool is a helical corkscrew bit.

6. The kit according to claim 1, wherein said packing extraction bit of said packing puller tool is a tapered threaded bit.

7. A tool for extracting packing from a stuffing box, comprising:

a packing puller including a shaft having a handle end with a handle affixed thereto and an opposite bit attachment end with a packing extraction bit affixed thereto for engaging the packing;

said shaft having a length and including a plurality of lever lugs affixed thereto at predetermined intervals along the length of said shaft for applying levering force to said packing puller for lifting said packing puller and the packing from the stuffing box.

8. The tool according to claim 7, wherein said shaft of said packing puller is rigid and inflexible.

9. The tool according to claim 7, wherein said shaft of said packing puller is flexible.

10. The tool according to claim 7, wherein said packing extraction bit is removably affixed to said bit attachment end of said shaft of said packing puller.

11. The tool according to claim 7, wherein said packing extraction bit of said packing puller is a helical corkscrew bit.

12. The tool according to claim 7, wherein said packing extraction bit of said packing puller is a tapered threaded bit.

* * * * *

UNITED STATES PATENT AND TRADEMARK OFFICE

CERTIFICATE OF CORRECTION

PATENT NO. 5,904,074
DATED May 18, 1999
INVENTOR(S) : Randy J. Hebert

It is certified that error appears in the above-indentified patent and that said Letters Patent is hereby corrected as shown below:

On the title page, under [19] and in [76]:

The inventor's last name should be spelled Hebert, instead of Herbert.

Signed and Sealed this

Eleventh Day of April, 2000

*Attest:*

*Attesting Officer*

Q. TODD DICKINSON

*Director of Patents and Trademarks*